US011744392B1

(12) United States Patent
Richards

(10) Patent No.: US 11,744,392 B1
(45) Date of Patent: Sep. 5, 2023

(54) CHRISTMAS TREE STAND FOR ARTIFICIAL TREES

(71) Applicant: Bryan Richards, Lawrenceville, GA (US)

(72) Inventor: Bryan Richards, Lawrenceville, GA (US)

( * ) Notice: Subject to any disclaimer, the term of this patent is extended or adjusted under 35 U.S.C. 154(b) by 0 days.

(21) Appl. No.: 17/963,217

(22) Filed: Oct. 11, 2022

(51) Int. Cl.
*A47G 33/12* (2006.01)

(52) U.S. Cl.
CPC ..... *A47G 33/12* (2013.01)

(58) Field of Classification Search
CPC ..... A47G 33/12; A47G 2033/124; A47G 2033/1266
See application file for complete search history.

(56) References Cited

U.S. PATENT DOCUMENTS 10,092,125 B1 * 10/2018 Braunberger ..... A47G 33/12
2005/0051695 A1 * 3/2005 Kovach ..... A47G 33/12 248/524
2014/0373440 A1 * 12/2014 Niklaus ..... A47G 33/12 47/40.5
2019/0174943 A1 * 6/2019 Schooley ..... A47G 33/12
2019/0298097 A1 * 10/2019 Hendricks ..... A47G 33/12
2020/0229629 A1 * 7/2020 Schooley ..... A47G 33/12
2020/0352379 A1 * 11/2020 Fiveash ..... A47G 33/12

FOREIGN PATENT DOCUMENTS

WO WO-03056983 A1 * 7/2003 ..... A47G 33/12
WO WO-2016112917 A1 * 7/2016 ..... A45B 25/00

* cited by examiner

*Primary Examiner* — Monica L Perry
*Assistant Examiner* — Aaron M Rodziwicz
(74) *Attorney, Agent, or Firm* — Charlena Thorpe, Esq.; Incorporating Innovation LLC

(57) ABSTRACT

A Christmas tree stand for artificial trees comprising a base, a hollow tubular member, a plurality of locking-folding mechanisms, and a plurality of movable elongated leg members. A method of using the Christmas tree stand comprises positioning the Christmas tree stand on a floor or surface and positioning and securing an artificial Christmas tree in the Christmas tree stand for displaying and viewing the tree.

17 Claims, 5 Drawing Sheets

CHRISTMAS TREE STAND FOR ARTIFICIAL TREES

CROSS REFERENCE TO RELATED APPLICATION

Technical Field

This disclosure relates to implementations of a Christmas tree stand for artificial trees.

BACKGROUND

An apparatus does not exist that can efficiently and effectively receive and secure the base of an artificial Christmas tree and safely and securely hold the tree in an upright position for displaying, viewing, etc. the artificial Christmas tree, including by adjusting the tilt of the Christmas tree to compensate for an unlevel floor surface or an otherwise leaning tree without the use of spacers, and that can further easily and efficiently be placed in a use configuration or in a storage or carry configuration.

DETAILED DESCRIPTION

Implementations of a Christmas tree stand for artificial trees ("Christmas tree stand") are provided. In some implementations, the Christmas tree stand comprises a base, a hollow tubular member, a plurality of locking-folding mechanisms, and a plurality of movable elongated leg members.

In some implementations, the Christmas tree stand is configured to safely and securely hold or otherwise support an artificial Christmas tree in an upright or standing position for displaying, viewing, etc. the tree.

In some implementations, the Christmas tree stand is configured to efficiently and effectively receive and secure an artificial Christmas tree (e.g., the base or lower portion thereof) for displaying, viewing, etc. the tree.

In some implementations, the Christmas tree stand is configured to easily and efficiently be placed in a use configuration or in a storage or carry configuration.

In some implementations, a method of using the Christmas tree stand comprises positioning the Christmas tree stand on a floor or other suitable surface in a use configuration and positioning and securing an artificial Christmas tree (e.g., the base or lower portion thereof) in the Christmas tree stand for displaying, viewing, etc. the tree.

Figure 1:
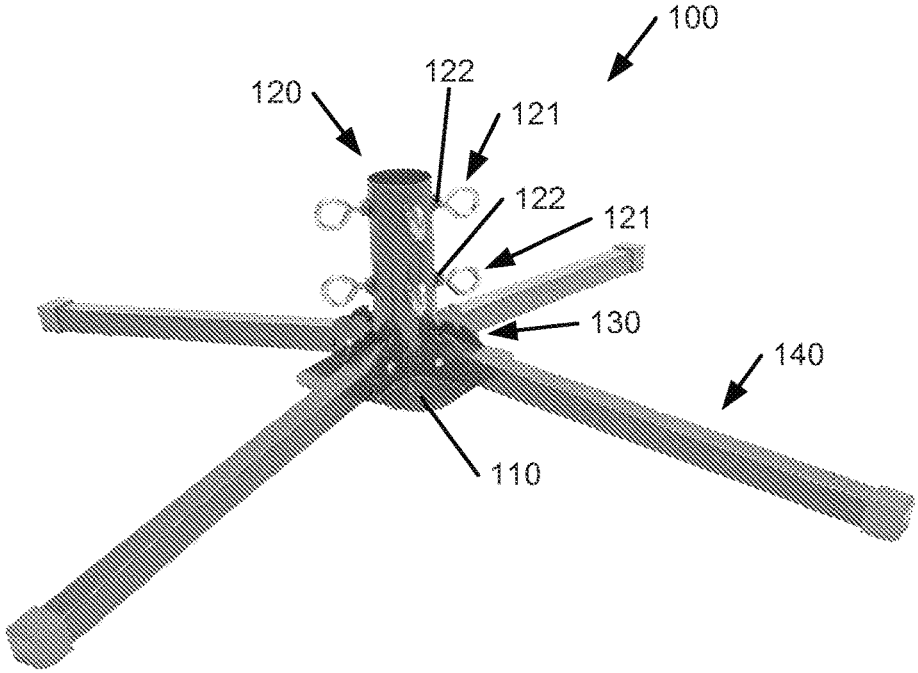
FIGS. 1-7 illustrate implementations of an example Christmas tree stand for artificial trees according to the present disclosure.
Figure 2:
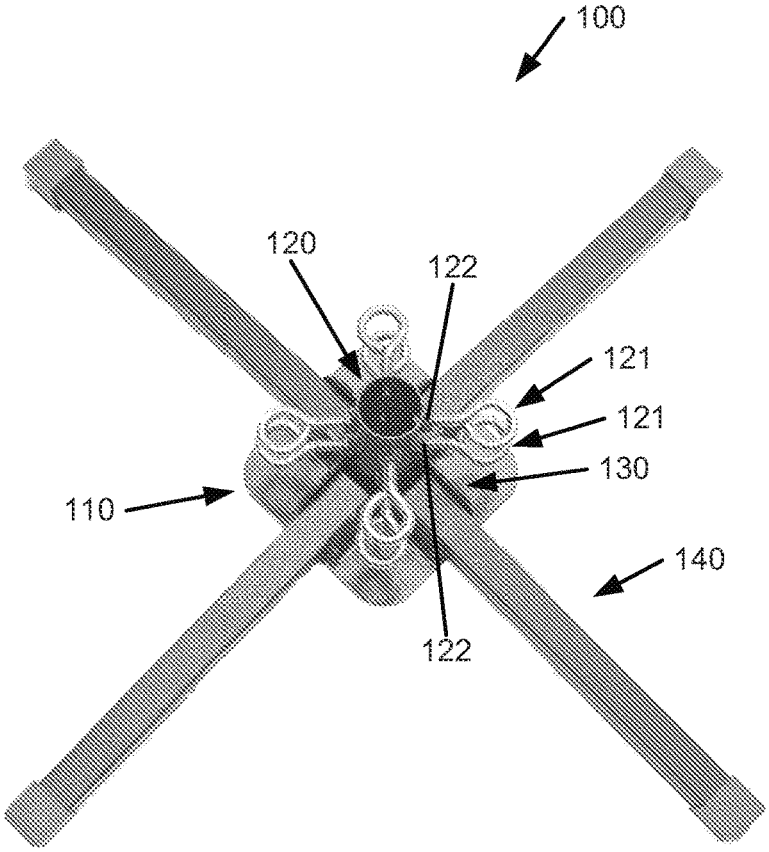

FIGS. 1-7 illustrate implementations of an example Christmas tree stand for artificial trees ("Christmas tree stand") 100 according to the present disclosure. As shown in FIGS. 1 and 2, in some implementations, the Christmas tree stand 100 comprises a base 110, a hollow tubular member 120, a plurality of locking-folding mechanisms 130, and a plurality of movable elongated leg members 140.

Figure 3:
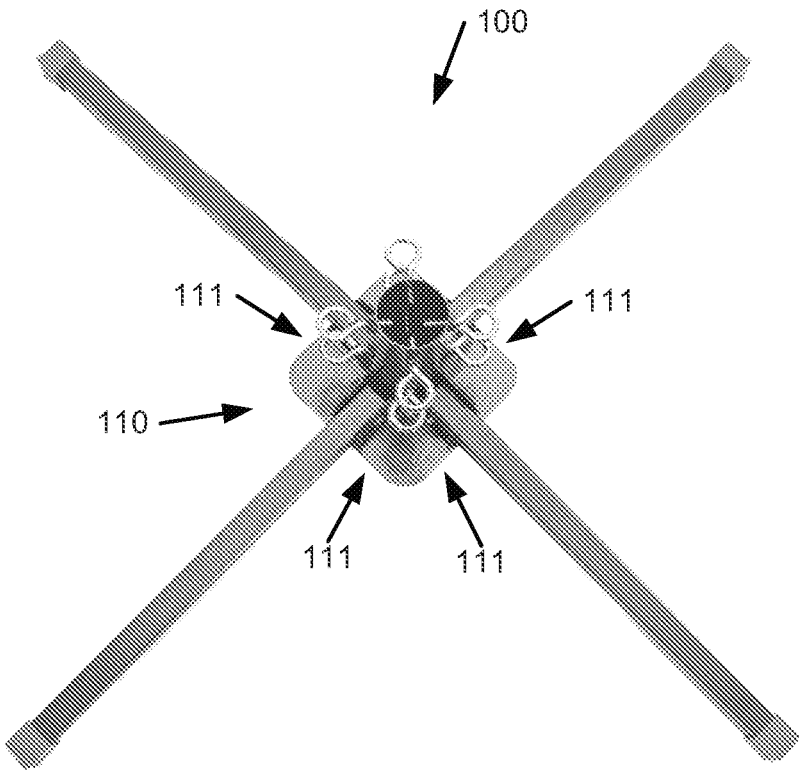
Figure 6:
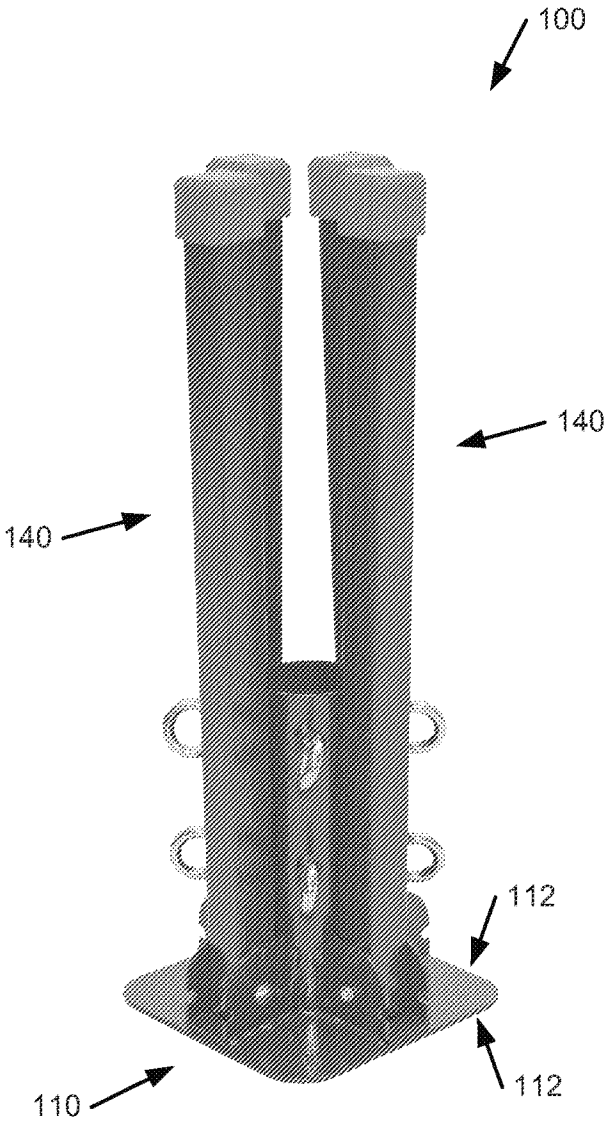
Figure 5:
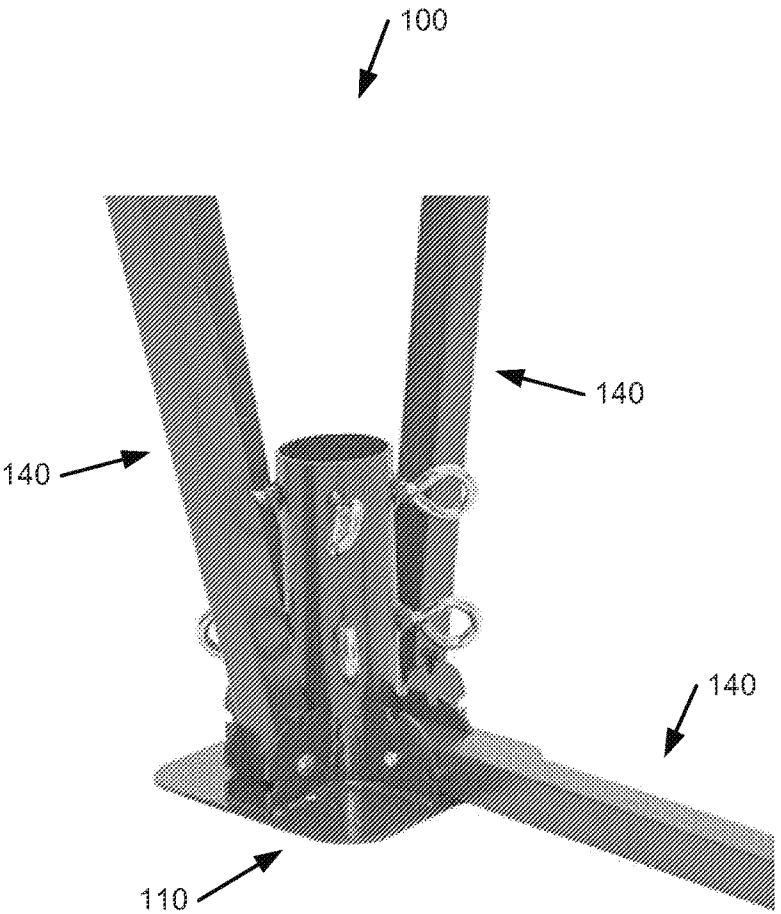

In some implementations, the base 110 may be any suitable size and/or shape. For example, as shown in FIGS. 3 and 6, in some implementations, the base 110 is generally square or rectangular, such as defined by the perimeter or sides 111 of the base 110. In some implementations, the base 110 is generally flat, such as defined by the top and bottom surfaces 112 extending between the sides 111 of the base 110.

In some implementations, the base 110 is configured to attach, connect, or otherwise support one or more components of the Christmas tree stand 100. For example, in some implementations, the base 110 is configured to attach to the hollow tubular member 120 and the locking-folding mechanisms 130, such as further described below.

In some implementations, the base 110 is configured to support the Christmas tree stand 100, for example in an upright or standing position. In some implementations, the base 110 is configured to stabilize the Christmas tree stand 100, for example in an upright or standing position.

In some implementations, the hollow tubular member 120 may be any suitable size and/or shape. For example, as shown in FIGS. 1 and 2, in some implementations, the hollow tubular member 120 is generally tubular, such as defined by the perimeter or wall(s) of the hollow tubular member 120. In some implementations, the hollow tubular member 120 is generally hollow, such as defined by the space or interior within the perimeter or wall(s) of the hollow tubular member 120.

As shown in FIGS. 1 and 2, in some implementations, the hollow tubular member 120 is attached to the base 110. In some implementations, the hollow tubular member 120 extends from the base 110, such as in an upward direction when the base 110 is positioned on a floor or other suitable surface.

In some implementations, the hollow tubular member 120 is configured to receive an artificial Christmas tree within the hollow opening or interior of the hollow tubular member 120. In some implementations, the hollow tubular member 120 is configured to hold or otherwise support an artificial Christmas tree in an upright or standing position within the hollow interior of the hollow tubular member 120.

In some implementations, the hollow tubular member 120 is configured to receive and hold the base or lower portion of an artificial Christmas tree. In some implementations, the hollow tubular member 120 may be configured to receive and hold any other suitable portion of an artificial Christmas tree.

Figure 4:
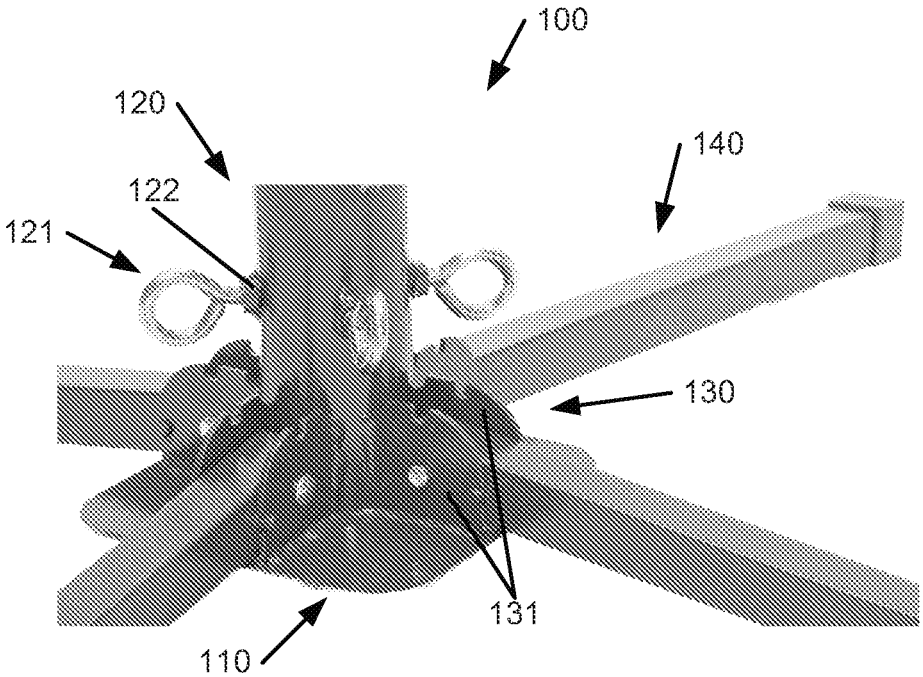
Figure 10:
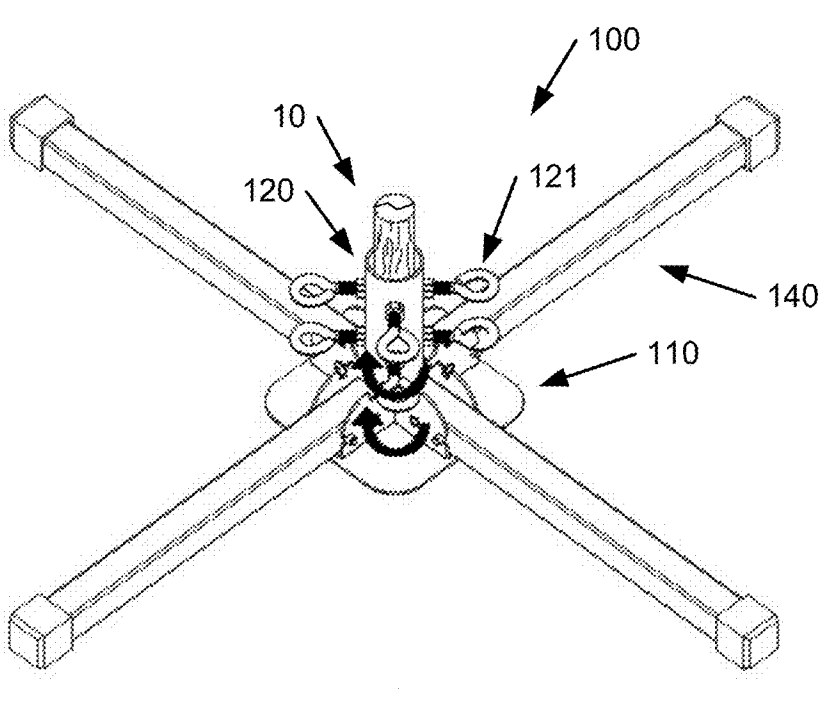
Figure 9:
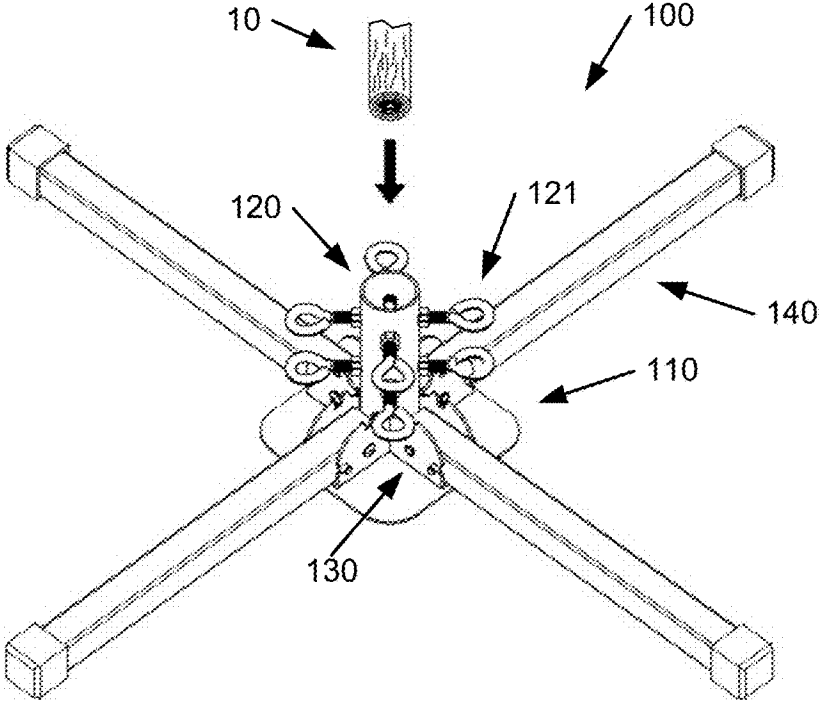

For example, as shown in FIGS. 3 and 4, in some implementations, the hollow tubular member 120 comprises a plurality of eyebolts 121 and openings 122 that allow the hollow tubular member 120 to hold an artificial Christmas tree 10 (such as shown in FIGS. 9 and 10).

As shown in FIGS. 1 and 2, in some implementations, the openings 122 extend through the wall of the hollow tubular member 120. In some implementations, the openings 122 are positioned spaced apart (e.g., generally equally) around the perimeter of the hollow tubular member 120.

In some implementations, the openings 122 are sized and shaped to receive and engage the eyebolts 121 therethrough. For example, in some implementations, the openings 122 may be threaded to engage with threads of the eyebolts 121.

In some implementations, the openings 122 may be configured (e.g., sized and shaped) in any other suitable way to receive and engage the eyebolts 121 therethrough.

As shown in FIG. 1, in some implementations, the openings 122 are arranged in (at least) two rows around the hollow tubular member 120. In some implementations, one row is positioned nearer to the upper or top portion of the hollow tubular member 120. In some implementations, the other row is positioned nearer to the lower or bottom portion of the hollow tubular member 120.

In this way, as further described below regarding the eyebolts 121, in some implementations, the Christmas tree stand 100 can thereby adjust the tilt of an artificial Christmas tree stood therein without the use of spacers, such as to compensate for an unlevel floor surface or an otherwise leaning tree.

As shown in FIG. 2, in some implementations, the openings 122 are further arranged such that each respective pair of openings 122 are aligned vertically between the upper and lower rows.

In some implementations, the openings 122 may be arranged or further arranged in any other suitable configuration.

In some implementations, the hollow tubular member 120 may comprise any suitable number of openings 122. For example, as shown in FIGS. 1 and 2, in some implementations, the hollow tubular member 120 comprises eight (8) openings 122 (i.e., four openings 122 in each row). In some implementations, the hollow tubular member 120 may comprise less than eight openings 122 (e.g., three or less openings 122 in each row). In some implementations, the hollow tubular member 120 may comprise more than eight openings 122 (e.g., five or more openings 122 in each row).

As shown in FIGS. 3 and 4, in some implementations, the eyebolts 121 may be any suitable eyebolts. For example, in some implementations, the eyebolts 121 may be any suitable size and/or shape.

In some implementations, any other suitable fastener may be used as the eyebolts 121, such as any suitable bolt, screw, pin, etc.

In some implementations, the eyebolts 121 are configured to engage with the openings 122 to hold or otherwise secure an artificial Christmas tree 10 within the hollow tubular member 120 (such as shown in FIGS. 9 and 10). For example, in some implementations, the eyebolts 121 are configured to screw in and out of the openings 122.

In some implementations, the circular or eye portion of the eyebolts 121 allow a user to hand tighten or loosen the eyebolts 121 in the openings 122.

As shown in FIG. 1, in some implementations, corresponding to the arrangement of the openings 122 through the hollow tubular member 120 that the eyebolts 121 are positioned therethrough, the eyebolts 121 are arranged in (at least) two rows around the hollow tubular member 120. As described above regarding the openings 122, in some implementations, one row is positioned nearer to the upper or top portion of the hollow tubular member 120. Similarly, in some implementations, the other row is positioned nearer to the lower or bottom portion of the hollow tubular member 120.

In this way, in some implementations, the eyebolts 121 can thereby be used (e.g., tightened, loosened, etc. accordingly to apply force, such as compressive force, within the hollow tubular member 120) to adjust the tilt of an artificial Christmas tree stood in the Christmas tree stand 100 without the use of spacers, such as to compensate for an unlevel floor surface or an otherwise leaning tree.

As shown in FIG. 2, in some implementations, also corresponding to the arrangement of the openings 122, the eyebolts 121 are further arranged such that each respective pair of eyebolts 121 are aligned vertically between the upper and lower rows.

In some implementations, the eyebolts 121 may be arranged or further arranged in any other suitable configuration, such as further corresponding to the arrangement of the openings 122.

In some implementations, the hollow tubular member 120 may comprise any suitable number of eyebolts 121, such as corresponding to the number of openings 122. For example, as shown in FIGS. 1 and 2, in some implementations, the hollow tubular member 120 comprises eight (8) eyebolts 121 (i.e., four eyebolts 121 in each row). In some implementations, the hollow tubular member 120 may comprise less than eight eyebolts 121 (e.g., three or less eyebolts 121 in each row). In some implementations, the hollow tubular member 120 may comprise more than eight eyebolts 121 (e.g., five or more eyebolts 121 in each row).

Figure 7:
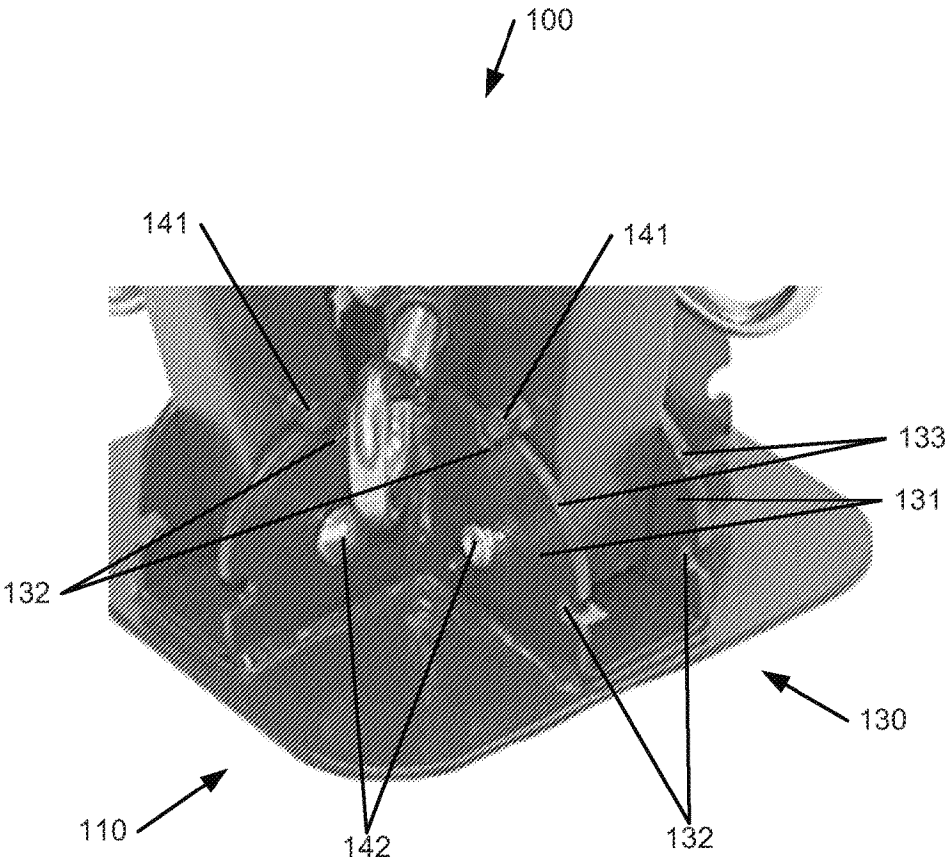

As shown in FIGS. 4 and 7, in some implementations, the locking-folding mechanisms 130 are attached to the base 110 and/or to the hollow tubular member 120. For example, in some implementations, the locking-folding mechanisms 130 are attached spaced apart (e.g., generally equally) around the perimeter of the hollow tubular member 120 on top of the base 110.

In some implementations, each locking-folding mechanism 130 comprises two (2) curved parallel plates 131 extending generally perpendicular from the base 110 and/or the hollow tubular member 120.

In some implementations, each locking-folding mechanism 130 comprises a plurality of notches or cutouts 132 on the curved edge or side 133 of the plates 131. In some implementations, the notches 132 allow the movable elongated leg members 140 to lock or otherwise secure in a position by engaging with the locking-folding mechanisms 130, such as described below.

In some implementations, the locking-folding mechanisms 130 may comprise any suitable number of notches 132, such as corresponding to the number of openings 122. For example, as shown in FIGS. 4 and 7, in some implementations, each locking-folding mechanism 130 comprises two (2) notches 132. In some implementations, the locking-folding mechanism 130 may comprise less than two notches 132. In some implementations, the locking-folding mechanism 130 may comprise more than two notches 132.

As shown in FIGS. 1 and 2, in some implementations, each movable elongated leg member 140 comprises an elongated member of any suitable size and/or shape. For example, in some implementations, the movable elongated leg members 140 may be generally cylindrical or rectangular shaped.

In some implementations, the movable elongated leg members 140 are tubular, such as generally hollow. In some implementations, the movable elongated leg members 140 may have any other suitable configuration.

As shown in FIGS. 1 and 2, in some implementations, each movable elongated leg member 140 is connected to and extends from a respective locking-folding mechanism 130. Thereby, each movable elongated leg member 140 is connected and extends spaced apart around the perimeter of the hollow tubular member 120 above the base 110.

In some implementations, each movable elongated leg member 140 is positioned and connected between the plates 131 of a respective locking-folding mechanism 130.

In some implementations, each movable elongated leg member 140 is movably connected to the respective locking-folding mechanism 130. For example, as shown in FIG. 8, in some implementations, each movable elongated leg member 140 is connected to the respective locking-folding mechanism 130 by a pin, bolt, or similar fastener 142 that extends at least partly through the locking-folding mechanism 130 and the movable elongated leg member 140.

As shown in FIGS. 4-8, in some implementations, the movable elongated leg members 140 are connected to the locking-folding mechanisms 130 such that the movable elongated leg members 140 are movable between a generally horizontal and vertical position when the Christmas tree stand 100 is positioned in an upright position.

Figure 8:
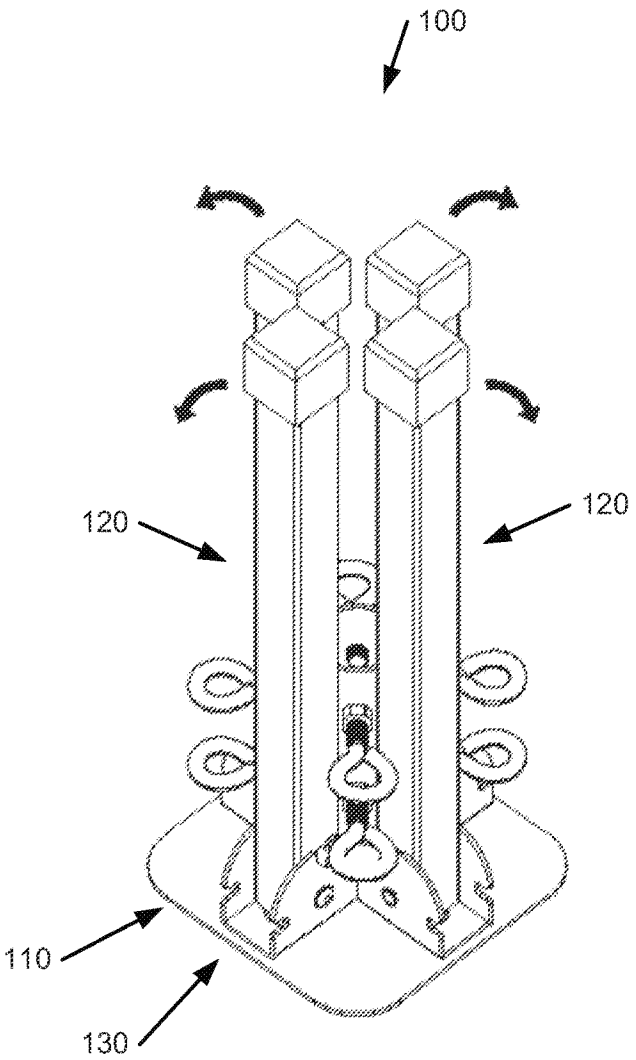
FIGS. 8-10 illustrate example uses of the Christmas tree stand for artificial trees according to the present disclosure.

As shown in FIG. 8, in some implementations, each movable elongated leg member 140 further comprises one or more pins 141 that are configured to engage with the notches 132 of the respective locking-folding mechanism 130 to thereby lock or otherwise secure the movable elongated leg member 140 in a generally horizontal, such as shown in FIG. 4, or vertical position, such as shown in FIG. 6.

In some implementations, the pins 141 may be stationary and the connection of the movable elongated leg members 140 to the respective locking-folding mechanisms 130 may be spring-loaded. In this way, in some implementations, the movable elongated leg members 140 can be pulled outward or otherwise moved away from the locking-folding mechanisms 130 such that the pins 141 are disengaged from (e.g., moved out of) the notches 132 at a first locked position. In some implementations, the movable elongated leg members 140 can thereby be rotated or otherwise moved from the first locked position to a second locked position at which the movable elongated leg members 140 spring-loadedly retract back toward the respective locking-folding mechanisms 130. In this way, in some implementations, the pins 141 engage with (e.g., move into) the notches 132 at the second position thereby locking the movable elongated leg members 140 in the second position.

Alternately, in some implementations, the pins 141 may be spring-loaded or otherwise movable to allow engagement with and disengagement from the notches 132. For example, in some implementations, the pins 141 can be pressed inward into the movable elongated leg members 140 to disengage the pins 141 from (e.g., move them out of) the notches at a first locked position. In this way, in some implementations, the movable elongated leg members 140 can be rotated or otherwise moved from the first locked position to a second locked position at which the pins 141 spring-loadedly extend back out from the movable elongated leg members 140 into (i.e., engaging) the notches 132 at the second position. In some implementations, the movable elongated leg members 140 are thereby locked in the second position.

In some implementations, the movable elongated leg members 140 and/or the pins 141 may be configured to engage or lock with and disengage or release from the notches 132 in any other suitable way such that the movable elongated leg members 140 can be moved from one locked position to another locked position (e.g., for use or storage of the Christmas tree stand 100 as described herein).

In some implementations, the Christmas tree stand 100 may comprise any suitable number of movable elongated leg members 140, such as corresponding to the number of locking-folding mechanisms 130. For example, as shown in FIGS. 1 and 2, in some implementations, the Christmas tree stand 100 comprises four (4) movable elongated leg members 140. In some implementations, the Christmas tree stand 100 may comprise less than four movable elongated leg members 140. In some implementations, the Christmas tree stand 100 may comprise more than four movable elongated leg members 140.

In some implementations, the movable elongated leg members 140 are configured to support the Christmas tree stand 100, for example in an upright or standing position. In some implementations, the movable elongated leg members 140 are configured to stabilize the Christmas tree stand 100, for example in an upright or standing position.

In some implementations, the movable elongated leg members 140 are configured to position in a generally horizontal position (such as shown in FIG. 4) for use of the Christmas tree stand 100 to hold an artificial Christmas tree in an upright or standing position (such as for displaying, viewing, etc. the tree). In some implementations, the movable elongated leg members 140 are configured to position in a generally vertical position (such as shown in FIG. 6) for storage, carrying, etc. of the Christmas tree stand 100.

In some implementations, the movable elongated leg members 140 may be adjustable in any suitable way. For example, in some implementations, the movable elongated leg members 140 may be adjustable in length, such as by a lockable, telescoping configuration.

In some implementations, the Christmas tree stand 100 is configured to safely and securely hold or otherwise support an artificial Christmas tree in an upright or standing position for displaying, viewing, etc. the tree.

In some implementations, the Christmas tree stand 100 is configured to efficiently and effectively receive and secure an artificial Christmas tree (e.g., the base or lower portion thereof) for displaying, viewing, etc. the tree.

In some implementations, the Christmas tree stand 100 is configured to easily and efficiently be placed in a use configuration, such as with the movable elongated leg members 140 positioned horizontally as shown in FIG. 4, or in a storage or carry configuration, such as with the movable elongated leg members 140 positioned vertically as shown in FIG. 6.

In some implementations, the Christmas tree stand 100 comprises any suitable dimensions. For example, in some implementations, the movable elongated leg members 140 may be 24 inches long or 36 inches long. In some implementations, the movable elongated leg members 140 may be less than 24 inches long. In some implementations, the movable elongated leg members 140 may be greater than 24 inches long and less than 36 inches long. In some implementations, the movable elongated leg members 140 may be greater than 36 inches long.

In some implementations, the Christmas tree stand 100 is composed of any suitable materials. For example, in some implementations, one or more components of the Christmas tree stand 100, such as the base 110, the hollow tubular member 120, the movable elongated leg members 140, and/or the locking-folding mechanisms 130, is composed of a heavy duty powder coated steel. In some implementations, one or more components of the Christmas tree stand 100 may be composed of an alloy steel.

In some implementations, one or more components of the Christmas tree stand 100 may be welded together (e.g., by a solid weld) or otherwise suitably attached. For example, in some implementations, the locking-folding mechanisms 130 is welded to the base 110.

In some implementations, the Christmas tree stand 100 can have any suitable appearance, such as shown in the figures described herein.

In some implementations, an example method of using the Christmas tree stand 100, with respect to the above-described figures, comprises positioning the Christmas tree stand 100 on a floor or other suitable surface in a use configuration. For example, as shown in FIGS. 8 and 9, in some implementations, the movable elongated leg members 140 are moved from a generally vertical storage or carry position to a generally horizontal use configuration.

In some implementations, the movable elongated leg members 140 are moved between positions by disengaging the pins 141 from a first corresponding notch(es) 132 of the respective locking-folding mechanisms 130 and engaging the pins to a second corresponding notch(es) 132 with respect to each position.

In some implementations, as shown in FIG. 9, the method comprises positioning the base or lower portion of an artificial Christmas tree 10 in the hollow tubular member 120. As shown in FIG. 10, in some implementations, the tree 10 is held or otherwise secured in an upright or standing position by tightening the eyebolts 121 in the openings 122. In some implementations, the artificial Christmas tree 10 is thereby secured in an upright position for displaying, viewing, etc. the tree.

In some implementations, the method may further comprise tightening, loosening, etc. accordingly the eyebolts 120 (e.g., to apply force, such as compressive force, to the base of the tree 10 within the hollow tubular member 120), such as shown in FIG. 10, to adjust the tilt of the artificial Christmas tree 10 stood in the Christmas tree stand 100, such as to compensate for an unlevel floor surface or an otherwise leaning tree 10.

In some implementations, the method may further comprise removing the artificial Christmas tree 10 from the Christmas tree stand 100 by reversing the foregoing respective steps to remove the tree from the positioning in the hollow tubular member 120.

In some implementations, the method may further comprise putting the Christmas tree stand 100 in a storage or carry position from the use position by moving the movable elongated leg members 140 from a generally horizontal position to a generally vertical position, such as shown in FIG. 8, by reversing the above respective steps.

Although the Christmas tree stand 100 is described herein with respect to an artificial Christmas tree, one skilled in the art in light of the present disclosure will understand that any other suitable tree or other suitable item may be similarly applied to the use of the Christmas tree stand 100.

The figures, including photographs and drawings, comprised herewith may represent one or more implementations of the Christmas tree stand for artificial trees.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A Christmas tree stand for artificial trees comprising:

a base having a plurality of sides defining a perimeter of the base and having a top surface and an opposite bottom surface extending between the perimeter;

a hollow tubular member extending from the top surface of the base and comprising:

a first end proximate to the top surface of the base;

a second end opposite the first end;

an elongated sidewall extending between the first end and the second end and defining a hollow interior therebetween and an opening into the hollow interior at the second end; and a plurality of openings positioned around and extending through the elongated sidewall and configured to receive a fastener therethrough;

a plurality of movable elongated leg members positioned above the base and around the hollow tubular member, wherein:

the movable elongated leg members extend away from the hollow tubular member; and each movable elongated leg member comprises a pin extending from the movable elongated leg member on each side of the movable elongated leg member near the end of the movable elongated leg member proximal to the hollow tubular member; and a plurality of locking-folding mechanisms corresponding respectively to the plurality of movable elongated leg members, wherein:

each locking-folding mechanism comprises two curved parallel plates positioned adjacent to the base and the hollow tubular member on opposite sides of a respective movable elongated leg member;

each plate comprises at least a first notch and a second notch each extending partly from the curved side into the plate, wherein the first notch is positioned near the base and the second notch is positioned near the hollow tubular member;

each movable elongated leg member is movably attached to a respective locking-folding mechanism in between the two curved parallel plates; and the pins of each movable elongated leg member are configured to engage respectively with the first notches or with the second notches of a respective locking-folding mechanism.

2. The Christmas tree stand for artificial trees of claim 1, wherein the plurality of openings of the hollow tubular member comprises:

a first plurality of the openings positioned around and extending through the elongated sidewall at a first location of the hollow tubular member; and a second plurality of the openings positioned around and extending through the elongated sidewall at a second location of the hollow tubular member.

3. The Christmas tree stand for artificial trees of claim 2, wherein the first location of the hollow tubular member is adjacent to the plurality of locking-folding mechanisms and the second location of the hollow tubular member is adjacent to the second end of the hollow tubular member.

4. The Christmas tree stand for artificial trees of claim 2, further comprising a plurality of fasteners corresponding respectively to the first and the second plurality of the openings.

5. The Christmas tree stand for artificial trees of claim 4, wherein the first and the second plurality of the openings and the plurality of fasteners are threaded respectively.

6. The Christmas tree stand for artificial trees of claim 4, wherein the plurality of fasteners comprises eyebolts.

7. The Christmas tree stand for artificial trees of claim 4, wherein the first and the second plurality of the openings each comprise four openings and the plurality of fasteners comprises eight corresponding fasteners.

8. A method of using the Christmas tree stand for artificial trees of claim 4, comprising:

locking each movable elongated member in a use position by positioning the bottom surface of the base and the plurality of movable elongated leg members on a floor surface, wherein the pins of the movable elongated leg member are engaged with the first notches of a respective locking-folding mechanism;

positioning the base of an artificial Christmas tree in the hollow interior of the hollow tubular member through the opening into the hollow interior at the second end of the hollow tubular member; and securing the base of the artificial Christmas tree within the hollow interior of the hollow tubular member by inserting the plurality of fasteners into the respective first plurality and second plurality of the openings of the hollow tubular member thereby securing the artificial Christmas tree in a standing position.

9. The method of claim 8, further comprising inserting or retracting the plurality of fasteners into or out of the respective first plurality and second plurality of the openings thereby adjusting the tilt of the artificial Christmas tree in the standing position.

10. The Christmas tree stand for artificial trees of claim 1, wherein the plurality of movable elongated leg members comprises four movable elongated leg members and the plurality of locking-folding mechanisms comprises four corresponding locking-folding mechanisms.

11. The Christmas tree stand for artificial trees of claim 1, wherein the perimeter of the base is rectangular.

12. The Christmas tree stand for artificial trees of claim 1, wherein the base, the hollow tubular member, the plurality of movable elongated leg members, and the plurality of locking-folding mechanisms are composed of heavy duty powder coated steel.

13. The Christmas tree stand for artificial trees of claim 1, wherein the plurality of locking-folding mechanisms are welded to the base in a solid weld.

14. A method of using the Christmas tree stand for artificial trees of claim 1, comprising:

locking each movable elongated leg member in a use position by positioning the bottom surface of the base and the plurality of movable elongated leg members on a floor surface, wherein the pins of the movable elongated leg member are engaged with the first notches of a respective locking-folding mechanism;

positioning the base of an artificial Christmas tree in the hollow interior of the hollow tubular member through the opening into the hollow interior at the second end of the hollow tubular member; and securing the artificial Christmas tree in a standing position within the hollow interior of the hollow tubular member.

15. A method of using the Christmas tree stand for artificial trees of claim 1, comprising:

locking each movable elongated member in a use position by positioning each movable elongated leg member such that the movable elongated member extends adjacent to the top surface of the base and, engaging the pins of each movable elongated leg member with the first notches of the respective locking-folding mechanism.

16. A method of using the Christmas tree stand for artificial trees of claim 1, comprising:

locking each movable elongated member in a use position by positioning each movable elongated leg member such that the movable elongated member extends adjacent to the elongated sidewall of the hollow tubular member and engaging the pins of each movable elongated leg member with the second notches of the respective locking-folding mechanism.

17. A Christmas tree stand for artificial trees comprising:

a base having a plurality of sides defining a rectangular perimeter of the base and having a top surface and an opposite bottom surface extending between the rectangular perimeter, wherein the base is composed of heavy duty powder coated steel;

a hollow tubular member extending from the top surface of the base, composed of heavy duty powder coated steel, and comprising:

a first end proximate to the top surface of the base;

a second end opposite the first end;

an elongated sidewall extending between the first end and the second end and defining a hollow interior therebetween and an opening into the hollow interior at the second end; and a first group of four openings positioned around and extending through the elongated sidewall adjacent to the plurality of locking-folding mechanisms and configured to receive a fastener therethrough;

a second group of four openings positioned around and extending through the elongated sidewall adjacent to the second end of the hollow tubular member and configured to receive a fastener therethrough; and a set of eight eyebolt fasteners configured to insert and retract respectively from the first and the second group of four openings;

a set of four movable elongated leg members positioned above the base and around the hollow tubular member, wherein:

the movable elongated leg members extend away from the hollow tubular member;

the movable elongated leg members are composed of heavy duty powder coated steel; and each movable elongated leg member comprises a pin extending from the movable elongated leg member on each side of the movable elongated leg member near the end of the movable elongated leg member proximal to the hollow tubular member; and a group of four locking-folding mechanisms corresponding respectively to the set of four movable elongated leg members, wherein:

each locking-folding mechanism comprises two curved parallel plates positioned adjacent to the base and the hollow tubular member on opposite sides of a respective movable elongated leg member;

each plate comprises at least a first notch and a second notch each extending partly from the curved side into the plate, wherein the first notch is positioned near the base and the second notch is positioned near the hollow tubular member;

the locking-folding mechanisms are composed of heavy duty powder coated steel;

the locking-folding mechanisms are welded to the base in a solid weld;

each movable elongated leg member is movably attached to a respective locking-folding mechanism in between the two curved parallel plates; and the pins of each movable elongated leg member are configured to engage respectively with the first notches or with the second notches of a respective locking-folding mechanism.

* * * * *